US006655676B2

(12) United States Patent
Nishimura

(10) Patent No.: US 6,655,676 B2
(45) Date of Patent: Dec. 2, 2003

(54) IMAGE FORMATION APPARATUS

(75) Inventor: Isao Nishimura, Niiza (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/193,236

(22) Filed: Jul. 12, 2002

(65) Prior Publication Data

US 2003/0020229 A1 Jan. 30, 2003

(30) Foreign Application Priority Data

Jul. 12, 2001 (JP) ..... 2001-212388

(51) Int. Cl.[7] ..... B65H 5/26

(52) U.S. Cl. ..... 271/9.05; 399/82; 399/85; 399/389; 399/391; 399/45

(58) Field of Search ..... 271/9.05; 399/82, 399/85, 389, 391, 45

(56) References Cited

U.S. PATENT DOCUMENTS 5,130,757 A * 7/1992 Ito ..... 399/14
5,162,853 A * 11/1992 Ito et al. ..... 399/54
5,459,580 A * 10/1995 Suzuki ..... 399/45
5,721,627 A * 2/1998 Kamiya ..... 399/82

* cited by examiner

*Primary Examiner*—Donald P. Walsh
*Assistant Examiner*—Matthew J. Kohner
(74) *Attorney, Agent, or Firm*—Oblon, Spivak, McClelland, Maier & Neustadt, P.C.

(57) ABSTRACT

An image formation apparatus including a paper feeding unit for selectively feeding color papers, each of which is assigned by an operation unit, and a controlling device, for controlling storing an assigned color paper data and an image data into a storage device, and for controlling selecting the same color paper when the image data is again output from the storage device. Therefore, the same image data can be automatically output to the same color paper.

6 Claims, 4 Drawing Sheets

IMAGE FORMATION APPARATUS

CROSS-REFERENCE TO RELATED APPLICATION

This application claims the priority benefit of Japanese application serial No. 2001-212388, filed on Jul. 12, 2001.

BACKGROUND OF THE INVENTION

1. Field of the Invention

This invention relates in general to an image formation apparatus, comprising a paper feeding unit for selectively feeding various color papers.

2. Description of Related Art

In the conventional technology, according to whether the content to be recorded or printed is monochrome or color, ordinary paper or color paper can be automatically selected. A color recording (printing) apparatus, capable of obtaining suitable low cost and high image quality respectively, is well known, such as Japanese Laid Open 08-132682. In addition, a facsimile apparatus, which comprises a specified information storage device for controlling the recording of received information on the color recording paper set by a specified color setting device, is also well known (refer to Japanese Laid Open 2000-059563).

Additionally, recently, due to the low price of computer hardware, after image data is output to the paper, the image data can still be held and stored in a hard disk for output at any time. This kind of image formation apparatus has become very popular.

As described above, in the conventional manner white recording paper and color recording paper are differently used to output image data thereon. However, once the image data is output to the recording paper, the image data is stored in a storage device. When the image data is further output to the recording paper again, the image data might be output to a recording paper with a color different from the previous paper, such that when outputting the same document, it might be output to a color recording paper with a color different from the desired color.

SUMMARY OF THE INVENTION

According to the foregoing description, an object of this invention is to provide an image formation apparatus, in which the same image data can be automatically output to the same color paper.

In order to achieve the above object, the invention provides an image formation apparatus, comprising a paper feeding unit for selectively feeding color papers each of which is assigned by an operation unit; and a controlling device, for controlling storing assigned color paper data and image data into a storage device, and for controlling selecting the color papers when the image data is output from the storage device again.

In the above image formation apparatus, by the control of the controlling device, the image data corresponding to the assigned color paper is selected to be output.

Additionally, the controlling device further comprises an adding function for adding a usage frequency of each color paper, and a display function on the operation unit for displaying an adding result.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

Figure 1:
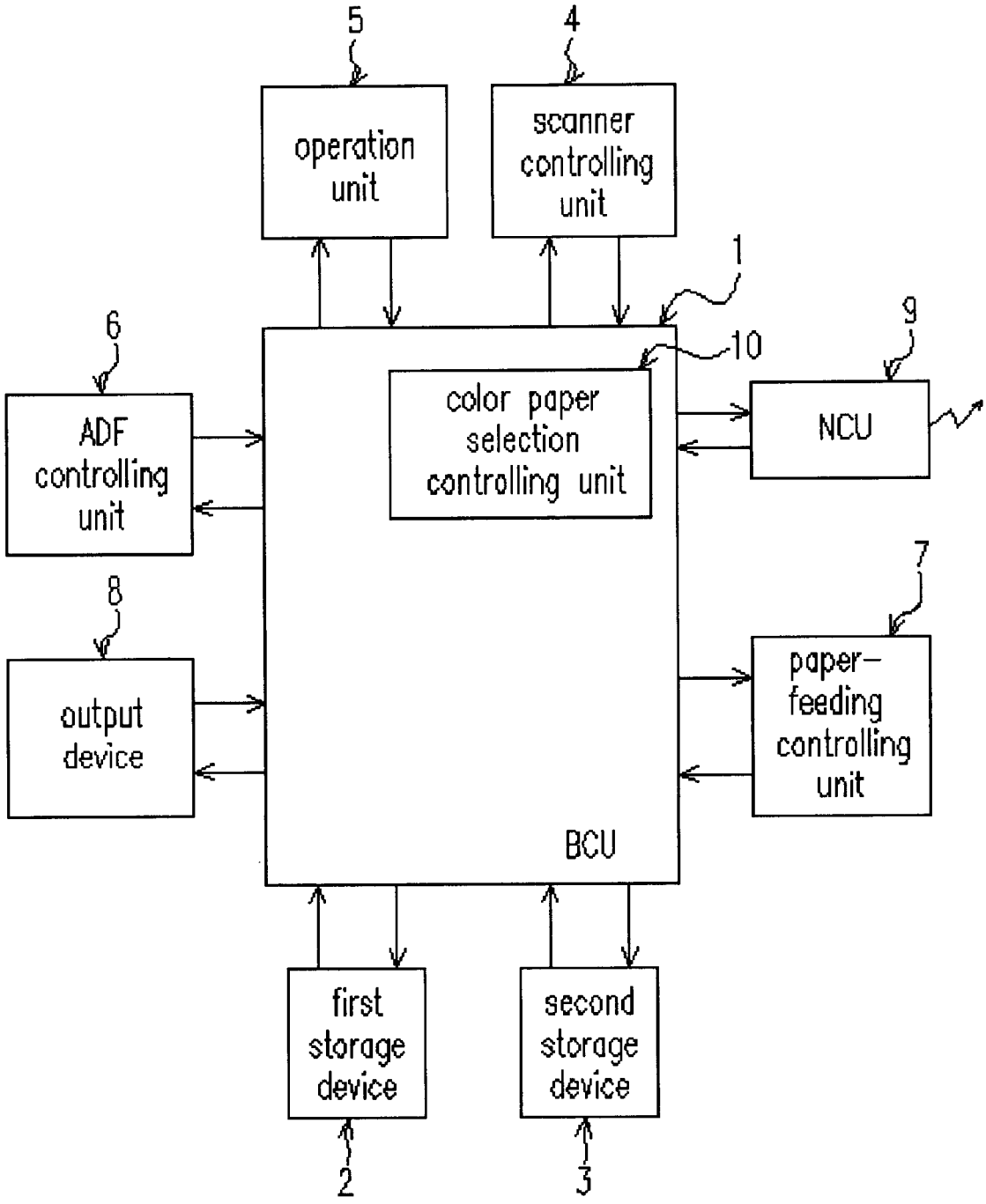
FIG. 1 is a controlling block diagram of the image formation apparatus according to the preferred embodiment of the invention.
Figure 2:
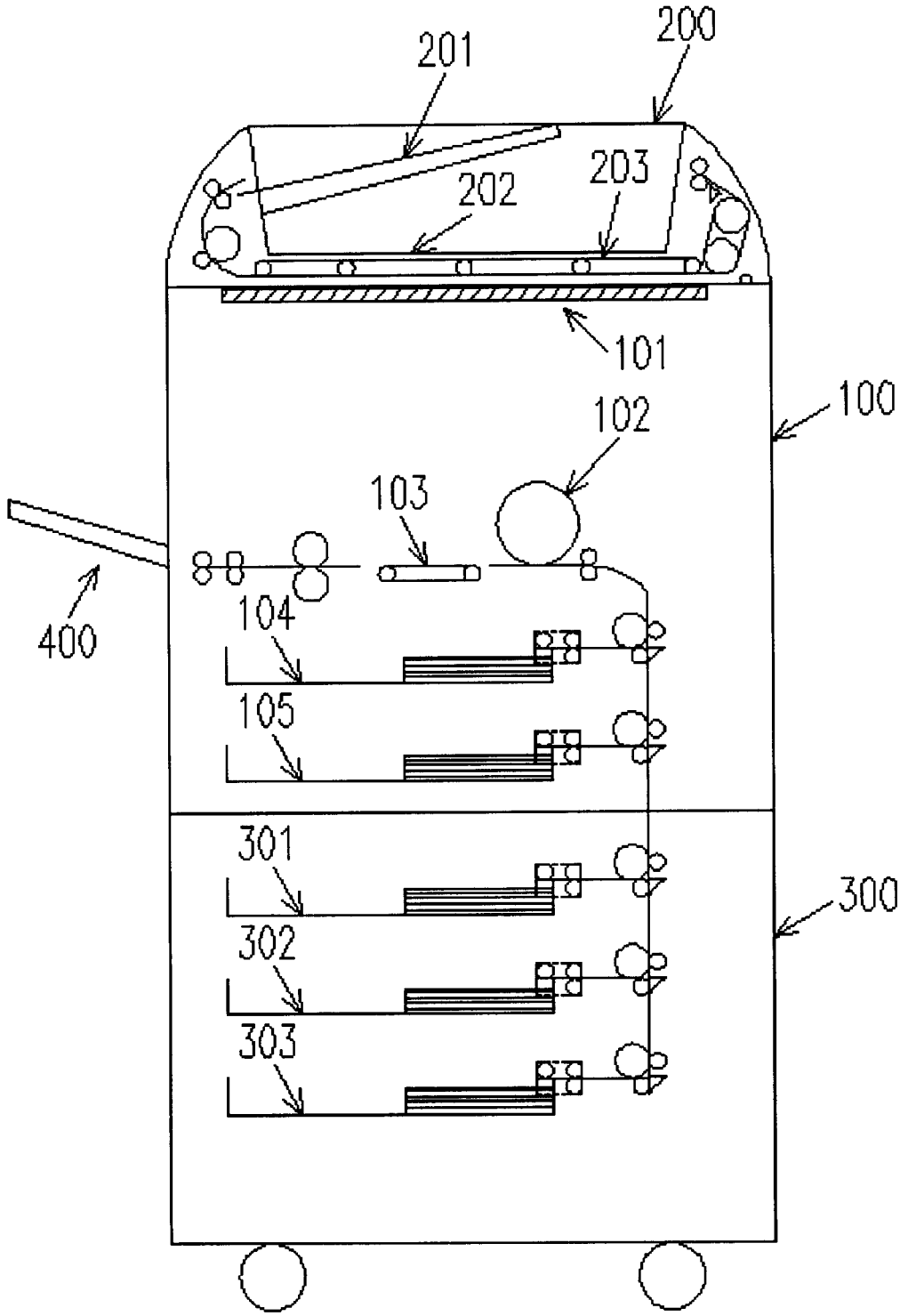
FIG. 2 is a schematic diagram showing the entire structure of the image formation apparatus.

The preferred embodiment of the invention is described in detail accompanied by the attached drawings. FIG. 1 is a controlling block diagram of the image formation apparatus according to the preferred embodiment of the invention. FIG. 2 is a schematic diagram showing the entire structure of the image formation apparatus. As shown in FIG. 1, the controlling system comprises a BCU 1 for performing various image processes, a first storage device 2 for storing image data, a second storage device 3 for storing various data, a scanner controlling unit 4 for scanning and reading the document, an operation unit 5 for performing a variety of operational processes, an ADF controlling unit 6 for controlling an automatic document sending device, a paper feeding controlling unit 7, a output device 8 for outputting printing on the paper, and an NCU 9 for performing the communication network control. In addition, the BCU 1 further comprises a color paper selection controlling unit (a background-color paper selection controlling unit) 10.

As shown in FIG. 2, the image formation apparatus 100 consists of a main body 100, an automatic document sending device 200 and an additional paper feeding device 300. The main body 100 has a paper ejecting tray 400 installed on the side thereof, and further comprises a contact glass 101, a photo sensing drum 102, a conveyer belt 103, a first paper feeding tray 104, a second paper feeding tray 105.

The automatic document sending device 200 comprises a document feeding platform 201, a paper ejecting tray 202, a conveyer belt 203. The additional paper feeding device 300 comprises a third paper feeding tray 301, a fourth paper feeding tray 302 and a fifth paper feeding tray 303. Except for the size of papers, each paper feeding tray 301, 302, or 303 is used as a tray for a specified color paper.

Figure 3:
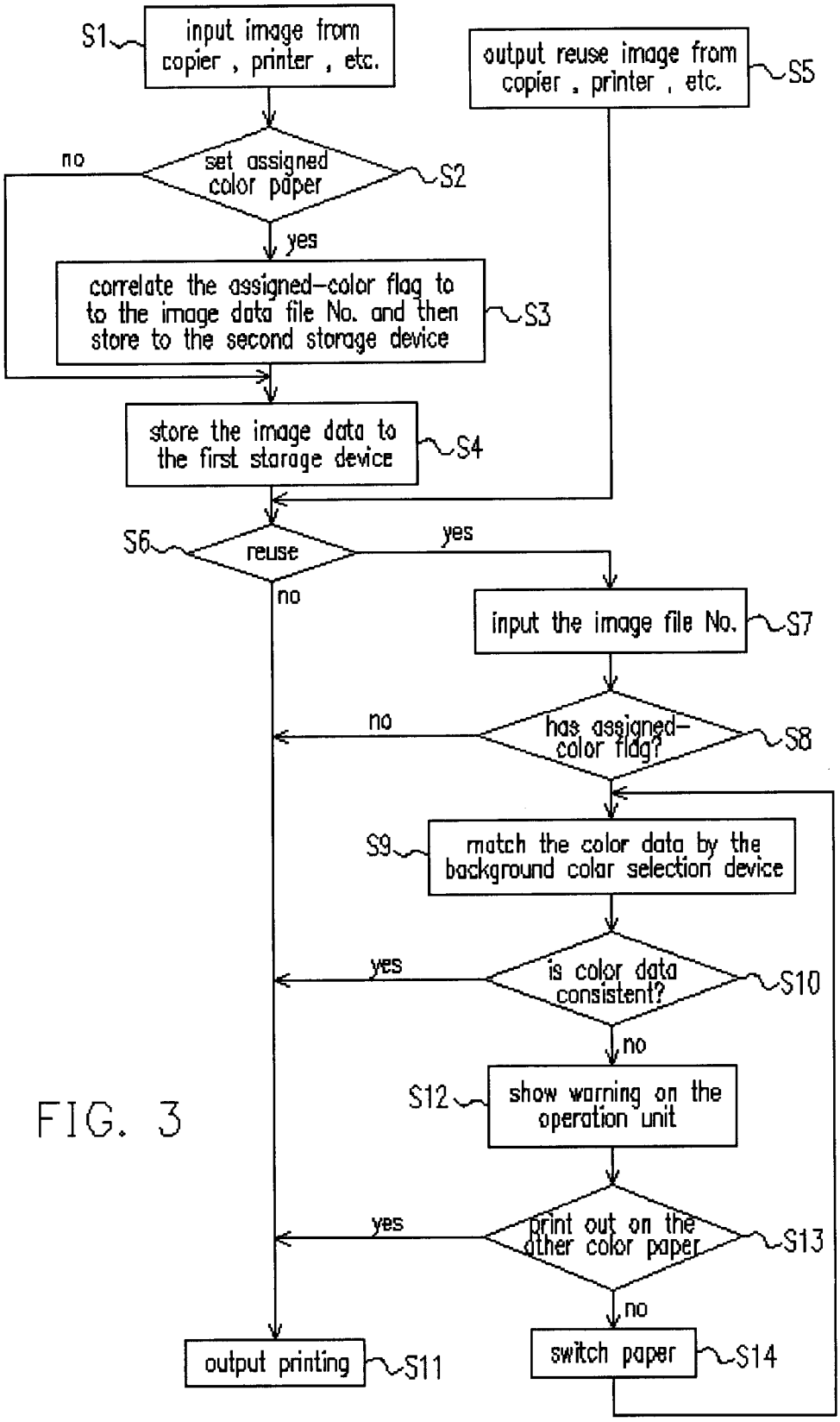
FIG. 3 is a flow chart showing an operation of the control of selecting papers.
Figure 4:
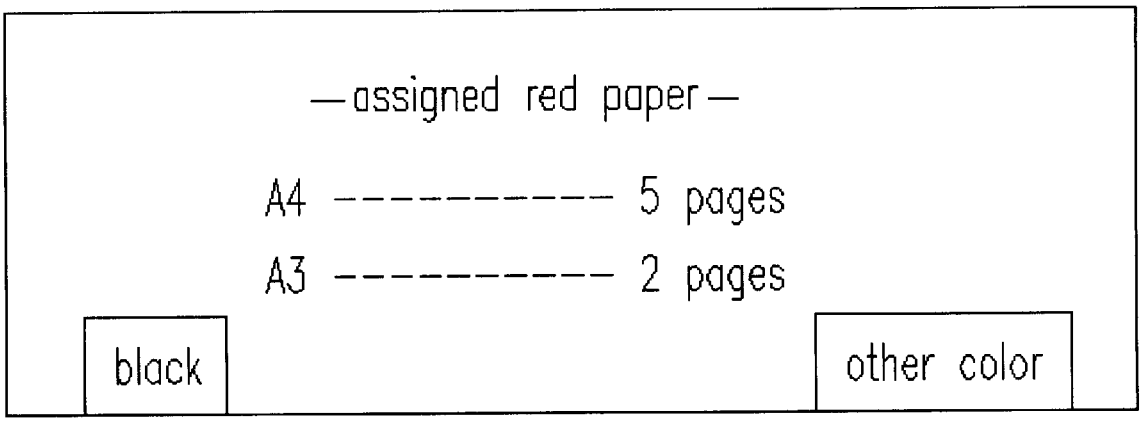
FIG. 4 is a an exemplary display of the operation unit.

FIG. 3 is a flow chart showing an operation of the paper selection control. FIG. 4 shows an exemplary display of the operation unit. The detailed operation is described as follows. At step S1, the image is input from a copier or a printer etc. According to the input image, whether there is an assignment of color papers from the operation unit 5 (see FIG. 1) is determined at step S2. When the assignment is made, for example, the first sheet is a white paper, the second sheet is a blue paper, and the third sheet is a white paper, the paper feeding trays (paper feeding trays 104, 105, 301, 302, 303 in FIG. 2) are assigned by the operation unit 5.

Thereafter, according to the above setting (assignment), the color paper selection controlling unit 10 controls the paper feeding controlling unit 7 and the selects in sequence the paper feeding trays containing the assigned color papers, by which the image is printed out onto the assigned color paper.

The image data is stored in the first storage device 2. The assigned color data, i.e., the first one is white, the second one is blue and the third one is white, is correlated to the image data, digitized and then stored in the second storage device 3 at steps S3, S4. When outputting the image data stored in the first storage device 2 (yes at steps S5, S6), the color data in the second storage device 3 is referenced. Then, the paper having the same color as the previous time, if the color data is consistent, is selected, and thereafter, the printing is output.

In addition, when there is no assigned color paper, a warning, that the color of the paper is different, is displayed on the operation unit 5 at step S12. At this time, a message that there exist papers with a similar color is displayed on the operation unit 5.

When there is no assigned color paper, whether the printing is performed on the other color paper is determined at step S13. When the other color paper can be used, the printing is output onto that color paper. In addition, when not printing onto the other color paper, the desired color papers are replaced or added at step S14.

In order to display the color of the paper on the operation unit 5, the structure and the technology disclosed in Japanese Laid Open 2000-0595 can be used. It is easy to use the timer to replace the image file number counter, so that an assigned color paper data within an assigned time interval is added into the image data stored in the first storage device 2, and then only the stored image is printed out.

In addition, when coloring an important image data, the operation unit 5 can also display a level at which the image data has been stored in the first storage device 2. The image formation apparatus of the invention is not only an independent unit, but also suitable for a facsimile through the NCU 9 (see FIG. 1), or a printer connected to the LAN etc.

According to the invention, when the image data output to an assigned color paper is called out from the storage device and then output again, because the previously assigned color paper is automatically selected, the image formation apparatus can be very convenient to use without an operator's intervention (where the operation is related to the color assignment of the paper).

In addition, according to the invention, because only the image data corresponding to the color paper assigned by the operator is printed out, the image formation apparatus can be very convenient to use without an operator's intervention (where the operation is related to the assignment of the image data).

According to the invention, because the usage amount of the color paper assigned by the operator can be determined on the operation unit, the storage amount of the image data corresponding to each color paper can be easily realized.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What claimed is:

1. An image formation apparatus, comprising:

a paper feeding unit configured to selectively feed color paper each of which is assigned by an operation unit;

a first storage device configured to store image data;

a second storage device configured to store an assigned color paper data corresponding to the image data; and a controlling device configured to control storing the assigned color paper data into the second storage device and the image data into the first storage device, and to control selecting the color paper when the image data is output from the storage device again, wherein the controlling device references the color paper data at a time of printing and selects a color paper having a same color as a color paper used in a previous printing when the color paper data is consistent with the color paper data of the previous printing.

2. The apparatus of claim 1, wherein by the control of the controlling device, the image data corresponding to the assigned color paper is selected to be output.

3. The apparatus of claim 1, wherein the controlling device comprises an adding function for adding a usage frequency of each color paper, and a display function on the operation unit for displaying an adding result.

4. An image formation apparatus, comprising:

a paper feeding means for selectively feeding color paper each of which is assigned by an operation unit;

a first storage means for storing image data;

a second storage means for storing an assigned color paper data corresponding to the image data; and a controlling means for controlling storing the assigned color paper data into the second storage means and the image data into the first storage means, and for controlling selecting the color paper when the image data is output from the storage means again, wherein the controlling means references the color paper data at a time of printing and selects a color paper having a same color as a color paper used in a previous printing when the color paper data is consistent with the color paper data of the previous printing.

5. The apparatus of claim 4, wherein by the control of the controlling means, the image data corresponding to the assigned color paper is selected to be output.

6. The apparatus of claim 4, wherein the controlling means comprises an adding function for adding a usage frequency of each color paper, and a display function on the operation unit for displaying an adding result.

* * * * *